US005769548A

United States Patent [19]

Thompson et al.

[11] Patent Number: 5,769,548

[45] Date of Patent: Jun. 23, 1998

[54] HOT STAMP IMPRINTING SYSTEM WITH LATCHABLE INK RIBBON CASSETTE & HANDLE

[75] Inventors: James A. Thompson, Downers Grove; Arne R. Jorgensen, Woodridge, both of Ill.

[73] Assignee: Illinois Tool Works Inc., Glenview, Ill.

[21] Appl. No.: 725,928

[22] Filed: Oct. 7, 1996

[51] Int. Cl.[6] ..... B41J 35/28

[52] U.S. Cl. ..... 400/208; 400/207

[58] Field of Search ..... 400/207, 208, 400/208.1, 247, 248, 249, 692

[56] References Cited

U.S. PATENT DOCUMENTS 5,011,310 4/1991 Wiechert ..... 400/207

*Primary Examiner*—Edgar S. Burr

*Assistant Examiner*—Daniel J. Colilla

*Attorney, Agent, or Firm*—John P. O'Brien

[57] ABSTRACT

An imprinting system having a typeface for transferring ink supplied from an inked ribbon roll onto a substrate, and an ink ribbon cassette removably coupleable to a mounting member of the imprinting system to facilitate service and maintenance. An alignment member of the imprinting system is disposeable in a first alignment aperture of the ink ribbon cassette to align the ink ribbon cassette relative to the imprinting system. A lever having an engagement surface is pivotally coupled to the ink ribbon cassette and is engageable with a locking pin coupled to the imprinting system, wherein the engagement surface of the lever is engageable with the locking pin as the lever is pivoted to firmly retain the ink ribbon cassette mounted on the mounting member. A handle having multiple gripping members is coupled to an outer side portion of the ink ribbon cassette to facilitate gripping the cassette and for stably supporting the ink ribbon cassette disassembled from the imprinting system.

11 Claims, 3 Drawing Sheets

HOT STAMP IMPRINTING SYSTEM WITH LATCHABLE INK RIBBON CASSETTE & HANDLE

CROSS-REFERENCE TO RELATED APPLICATIONS

The present application is related to the following several co-pending applications U.S. application Ser. No. 08/725,932, filed 7 Oct. 1996 and entitled "Hot Stamp Imprinting System With Backup Pad Assembly", U.S. application Ser. No. 08/725,930, filed 7 Oct. 1996 and entitled "Hot Stamp Imprinting System With Locking Cam Reel Hubs", and U.S. application Ser. No. 08/725,929, filed 7 Oct. 1996 and entitled "Hot Stamp Imprinting System With Variable Typeholder", all assigned to the common assignee of the present invention and incorporated herein by reference.

BACKGROUND OF THE INVENTION

The invention relates generally to imprinting systems, and more particularly to hot stamp imprinters having an ink ribbon cassette removably coupleable to the imprinter, and a handle for gripping the ink ribbon cassette.

Hot stamp imprinting systems are used often by the packaging industry in labeling and packaging production lines to produce high quality imprints of lot numbers, expiration dates, production codes, and other variable information on a variety of substrates including labels and packages. Hot stamp imprinter systems include generally an inked ribbon disposed between a backup pad and a heated print head assembly. The print head assembly usually includes a typeholder with a typeface having alpha-numeric characters and logos, which is movable toward and away from the backup pad by a cam or pneumatic actuator mechanism to transfer ink onto a portion of substrate between the inked ribbon and the backup pad. Between imprints, the inked ribbon is advanced from a ribbon supply roll to a ribbon take-up roll to position an unused portion of inked ribbon between the print head assembly and the backup pad for the next imprint. The substrate is also advanced between imprints by a substrate feed mechanism to position an adjacent portion of the substrate between the print head and the backup pad for the next imprint.

Some imprinting systems include an ink ribbon cassette removably coupleable to a base portion of the imprinting system to facilitate ink ribbon roll replacement and to provide access to the interior of the imprinting system for service and maintenance. Existing ribbon cassettes, however, require some disassembly and reassembly for removal and installation relative to the imprinting system. In addition, the installation procedure requires precise alignment of the cassette with the imprinting system, which is tedious and tends to be difficult for unskilled personnel. And failed installation attempts due to improper alignment sometimes result in damage to the ink ribbon, or to the cassette, or to portions of the imprinting system.

Many removable ink ribbon cassettes include a handle to facilitate removal and installation of the cassette relative to the imprinting system. Existing handles include, for example, a knob or other member protruding from an outer exposed side portion of the cassette opposite the side portion supporting the ribbon rolls. The inventors recognize, however, that existing handles frequently obstruct or frustrate ribbon replacement after the cassette is removed from the imprinting system. More specifically, existing handles prevent the ink ribbon cassette from being stably supported on the outer side portion from which the handle protrudes.

As a result, the cassette has a tendency to vacillate, or rock, about the protruding handle during efforts at replacement of the ribbon rolls, which is often frustrating. The inventors also recognize that the gripping surface of existing cassette handles is not always readily accessible to service and maintenance personnel depending on how the imprinting system is oriented or mounted relative to the production line operation. Inadequate handle gripping surface accessibility sometimes results in improper handling of the cassette during removal and particularly during cassette installation, which may result in damage as discussed above.

In view of the discussion above, among other considerations, there exists a demonstrated need for an advancement in the art of imprinting systems with an ink ribbon cassette and handle assembly.

It is therefore an object of the invention to provide a novel imprinting system with an improved ink ribbon cassette and handle assembly that overcomes problems in the prior art.

It is another object of the invention to provide a novel imprinting system with an ink ribbon cassette that is readily alignable with the imprinting system during assembly.

It is also object of the invention to provide a novel imprinting system with an ink ribbon cassette that is securely coupleable to the imprinting system by a lever pivotally coupled to the ink ribbon cassette, wherein the lever is engageable with a locking pin coupled to the imprinting system.

It is another object of the invention to provide a novel imprinting system with an ink ribbon cassette alignable with the imprinting system by one or more alignment members coupled to the imprinting system and engageable with the ink ribbon cassette, wherein the aligned ink ribbon cassette is drawn toward and locked into engagement with one or more mounting members coupled to the imprinting system by a lever pivotally coupled to the ink ribbon cassette and having an engagement surface engageable with a locking pin coupled to the imprinting system.

It is a further object of the invention to provide a novel imprinting system with an ink ribbon cassette having a handle with a relatively flat surface portion a useable for providing a stable support platform for the ink ribbon cassette disassembled from the imprinting system.

It is yet a further object of the invention to provide a novel imprinting system with an ink ribbon cassette having a handle with multiple gripping surfaces to facilitate handling and removing the ink ribbon cassette from the imprinting system, which may be mounted in any orientation.

It is another object of the invention to provide a novel imprinting system with an ink ribbon cassette having an ergonomically shaped, lightweight handle coupled to the ink ribbon cassette with reduced materials and structural fabrication.

These and other objects, features and advantages of the present invention will become more fully apparent upon consideration of the following Detailed Description of the Invention with the accompanying Drawings, which may be shown disproportionately for ease of understanding, wherein like structure and steps are referenced by corresponding numerals and indicators.

DETAILED DESCRIPTION OF THE INVENTION

Figure 1:
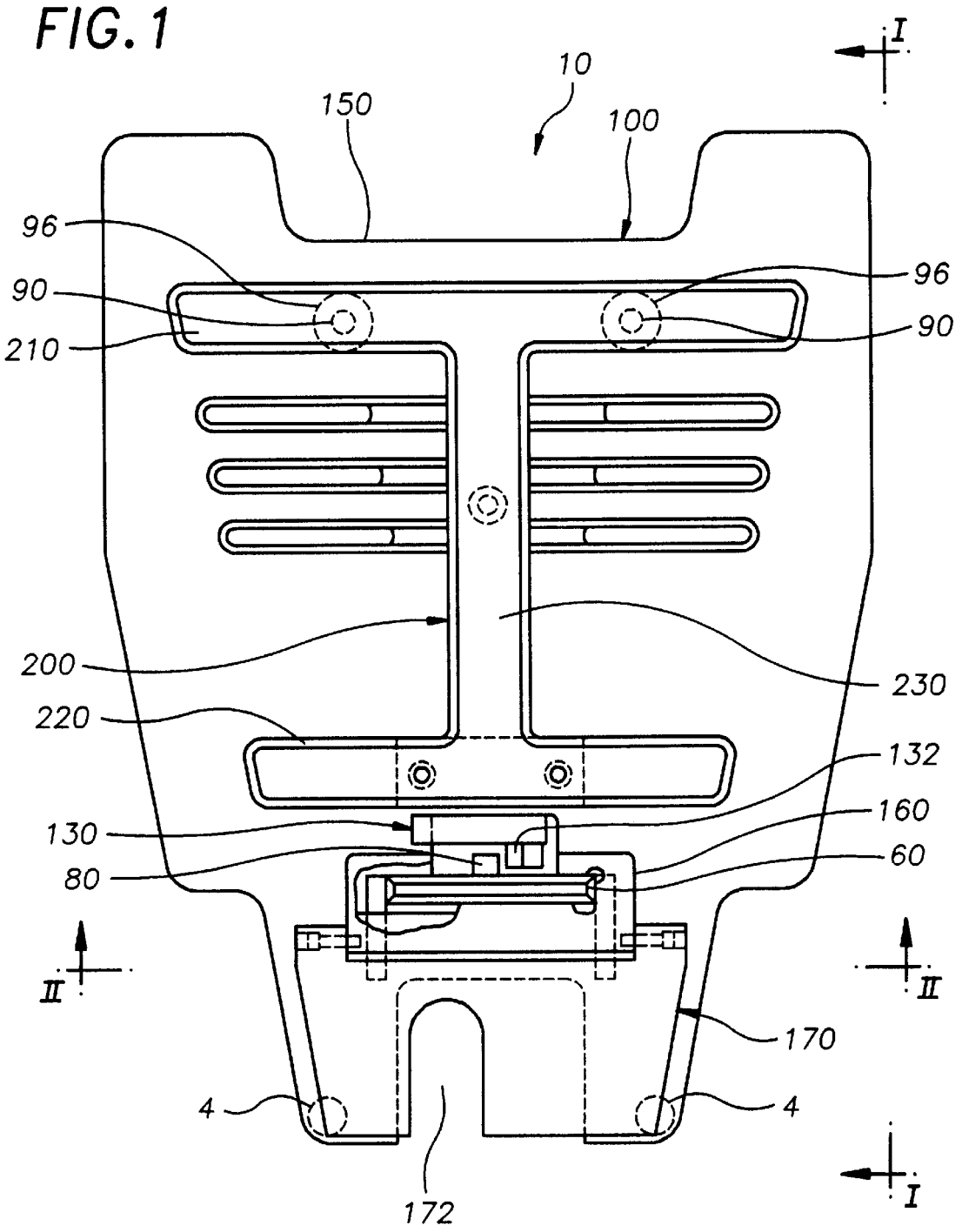
FIG. 1 is a partial elevation view of an imprinting system 10 with an ink ribbon cassette according to an exemplary embodiment of the invention.
Figure 2:
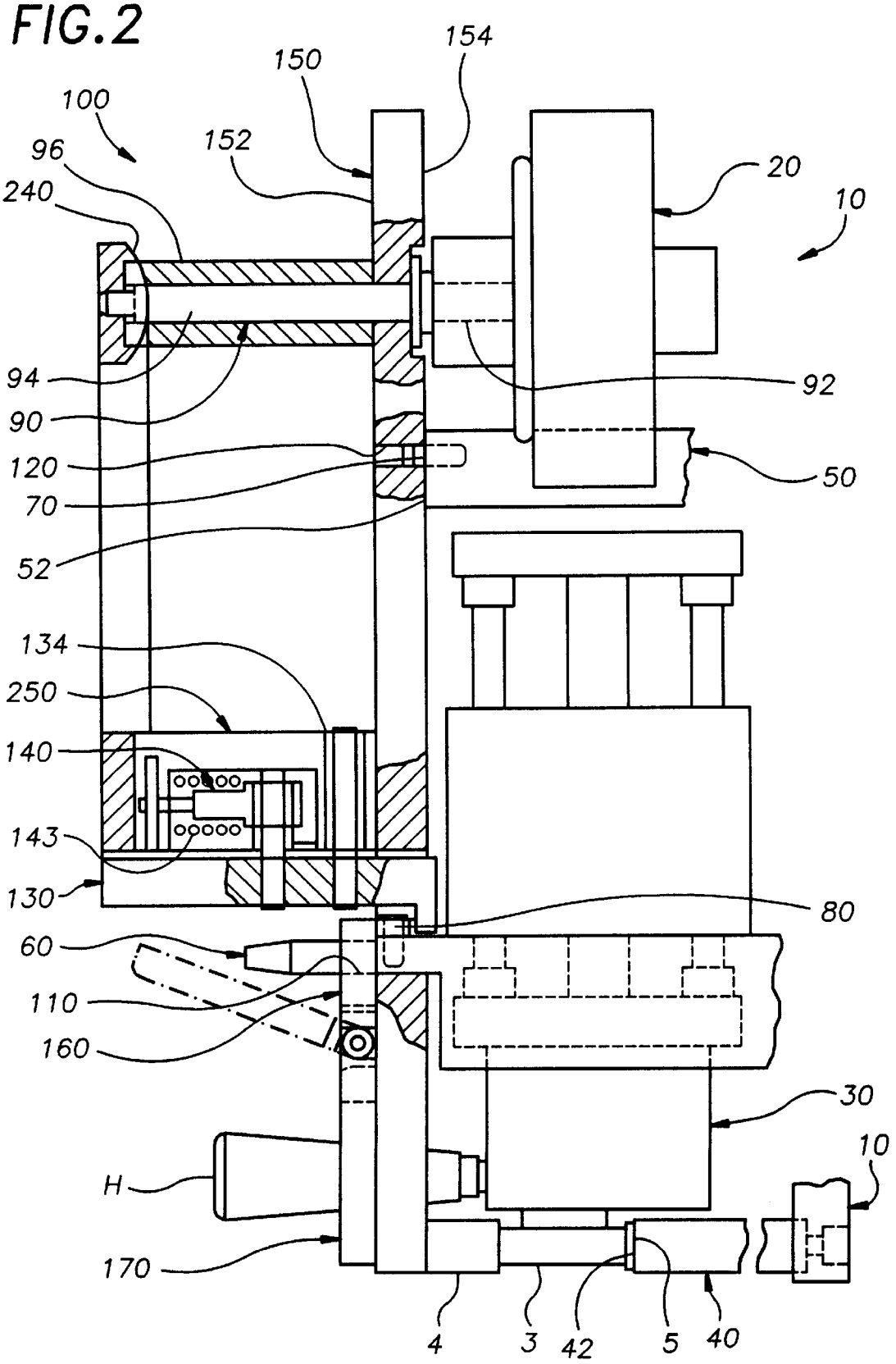
FIG. 2 is a partial side view of an imprinting system 10 with an ink ribbon cassette taken along lines I—I of FIG. 1.

FIGS. 1 and 2 are views of a imprinting system 10 with a removably coupleable ink ribbon cassette 100 according to an exemplary embodiment of the invention. Generally, one or more ink ribbon rolls 20 are rotatably coupled to the ink ribbon cassette 100 for supplying ribbon between a typeface of print head 30 for transferring ink onto a substrate, not shown in the drawing. Although the imprinting system in the exemplary embodiments is a hot stamp imprinting system, many aspects, features and advantages of the invention are also useful in other applications having a removably coupleable ribbon cassette including systems that print on paper rolls rotatably supportable on a removably coupleable paper roll cassette.

According to one aspect of the invention, the ink ribbon cassette 100 is mountable on one or more mounting surfaces of corresponding mounting members coupled to the imprinting system 10, wherein the mounting members include any structural member suitable for locating and supporting the ink ribbon cassette 100 relative to the imprinting system 10 as required for supplying print ribbon as discussed above. In the exemplary embodiment of FIGS. 1 and 2, the mounting members include two first support surfaces 42 of corresponding first support members 40 coupled to the imprinting system 10, and a second support surface 52 of a second support member 50 also coupled to the imprinting system 10. The ink ribbon cassette 100 includes two ribbon idler shafts 3 rotatably mounted on corresponding idler support shafts 4 having corresponding end portions 5, which are each mountable on a corresponding support surface 42 of the support members 40. A body portion of the ink ribbon cassette 100 is also mountable on the second support surface 52 of the second support member 50 when the idler support shafts 4 are mounted on the corresponding support members 40.

According to another aspect of the invention, a first alignment member 60 is coupled to the imprinting system 10, wherein the first alignment member 60 is disposeable in a first aperture 110 of the ink ribbon cassette 100 to align the ink ribbon cassette 100 with the imprinting system 10. In the exemplary embodiment, the first alignment member 60 is a tongue member having major and minor axes protruding from the imprinting system 10. The tongue member 60 is disposeable in a complementary first alignment aperture 110 in the ink ribbon cassette 100, wherein the first aperture 110 guides over the tongue member 60 to align the ribbon cassette 100 on the imprinting system 10. According to this aspect of the invention, the first alignment member 60, in cooperation with the corresponding alignment aperture 110, positively and accurately aligns the ink ribbon cassette 100 relative to the imprinting system 10 during and after assembly of the ink ribbon cassette 100 mounted on the first support members 40 and on the second support member 50 of the imprinting system 10 as discussed above.

A second alternative alignment member 70 is coupled to the imprinting system 10, and the second alignment member 70 is disposeable in a second alignment recess or aperture 120 in the ink ribbon cassette 100 to further align the ink ribbon cassette 100 with the imprinting system 10 during and after assembly. The second alignment member 70 of the exemplary embodiment is an alignment stud protruding from the second support member 50 and is at least partially extendable into the second alignment recess 120 of the ink ribbon cassette 100. According to this alternative configuration of the invention, the first alignment member 60 is disposeable in the first alignment aperture 110 before the second alignment member 70 is disposeable in the second alignment recess 120, wherein both alignment members 60 and 70 cooperate to positively align and locate the ink ribbon cassette 100 on the imprinting system 10 during and after assembly thereof.

Figure 3:
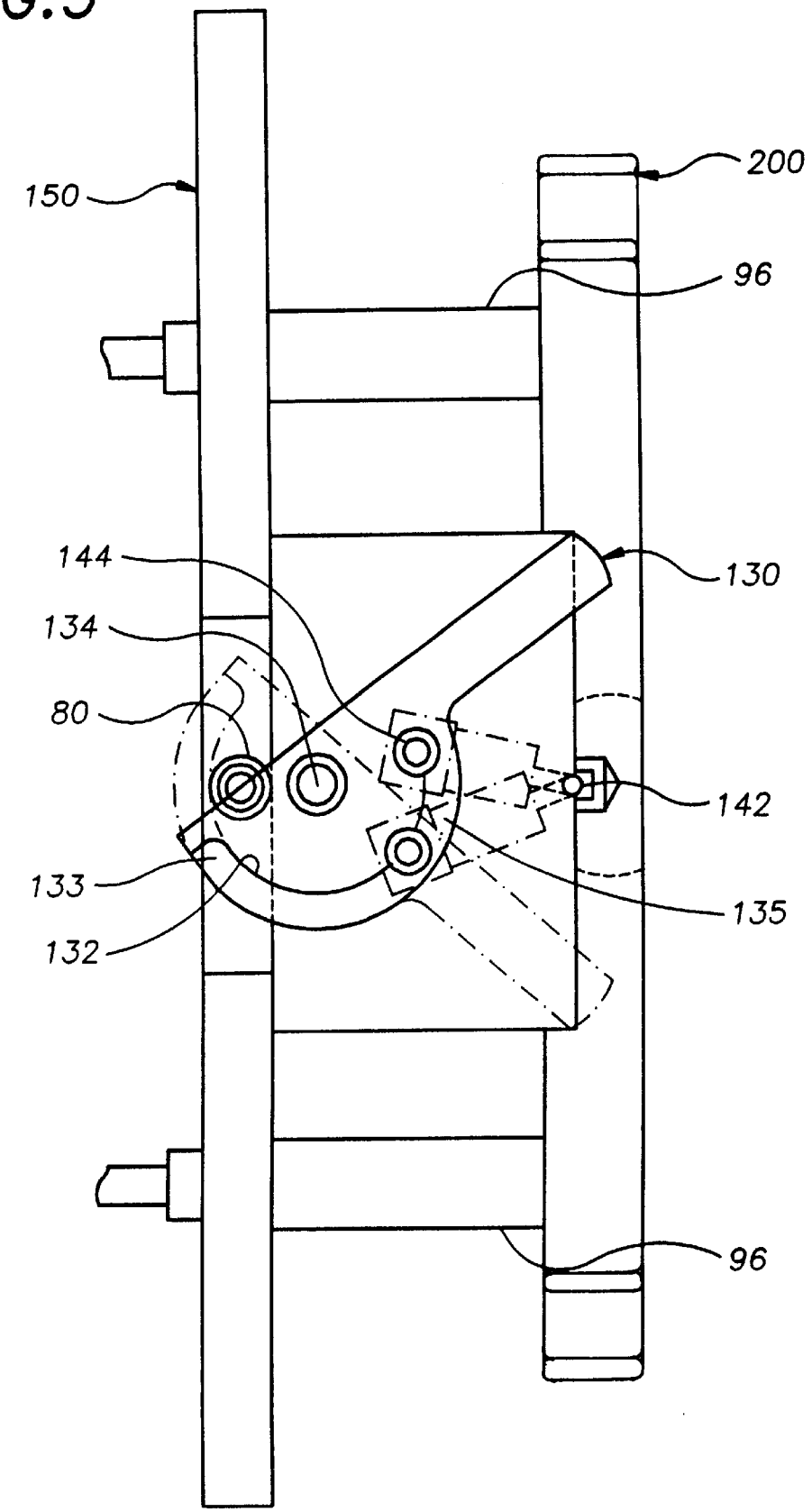
FIG. 3 is a partial view of a latch assembly for an ink ribbon cassette taken along lines II—II of FIG. 1 according to an exemplary embodiment of the invention.

According to another aspect of the invention, a lever 130 having an engagement surface 132 is pivotally coupled to the ink ribbon cassette 100 by a pivot pin 134, which may be coupled to the ink ribbon cassette 100 by one or more bearings. FIG. 2 shows the engagement surface 132 of the lever 130 engageable with a locking pin 80 coupled to the imprinting system 10 when the ink ribbon cassette 100 is mounted or seated on the mounting member of the imprinting system 10. And FIG. 3 shows the engagement surface 132 engageable with the locking pin 80 when the lever 130 is pivoted about the pivot pin 134. According to the exemplary embodiment of the invention, the engagement surface 132 of the lever 130 is engageable with the locking pin 80 as the lever is pivoted to firmly retain the ink ribbon cassette 100 mounted on the first support surfaces 42 and second support 52 of the corresponding first and second support members 40 and 50. The lever 130 is manually pivotable to lock and unlock the ink ribbon cassette 100 relative to the imprinting system 10.

According to a related aspect of the invention, the engagement surface 132 of the lever 130 is an arcuate surface with a decreasing radius of curvature. As shown in FIG. 3, the radius between the pivot pin 134 and engagement surface 132 decreases between a first end portion 133 and a second end portion 135 of the engagement surface 132. According to this aspect of the invention, the first end portion 133 of the arcuate surface is first engageable with the locking pin 80 when the ink ribbon cassette 100 is aligned and separated a small distance from the imprinting system 10. As the lever 130 is rotated, or pivoted, about the pivot axis 134, the decreasing radius of the arcuate engagement surface 132 draws the ink ribbon cassette 100 toward the imprinting system 10 and into contact with the mounting surfaces of the mounting members. And when latched, the lever 130 pulls down on the locking pin 80 urging the ink ribbon cassette 100 against the mounting surfaces of the mounting members of the imprinting system 10. In the exemplary embodiment, the lever 130 pulls down on the locking pin 80 and urges the end portions 5 of the idler support shafts 4 into engagement with the first support surfaces 42 of corresponding first support members 40, and also urges the inked ribbon cassette 100 into engagement with the second support surface 52 of the second support member 50, wherein the latched lever 130 firmly retains the ink ribbon cassette 100 mounted on the imprinting system 10.

According to another aspect of the invention, the locking pin 80 is rotatably coupled by a bearing or other means to facilitate rotation about a rotation axis during engagement by the engagement surface 132 of the lever 130. The rotatable locking pin 80 thus reduces the force required to pivot the lever 130, and reduces wear on the locking pin 80 and on the lever engagement surface 132. According to a related aspect of the invention, a biasing member 140 under the influence of a spring member 143 urges, or biases, the end portion 135 of the engagement surface 132 into engagement with the locking pin 80, in a latched position, to lockingly retain the ink ribbon cassette 100 mounted on the imprinting system 10 as discussed above. According to the exemplary embodiment, a first end portion 142 of the biasing member 140 is pivotally coupled to the cassette 100, and a second end 144 of the biasing member 140 is pivotally coupled to the lever 130. The lever 130 is unlatched by manually pivoting the lever 130 from the latched position, shown in phantom in FIG. 3, against the action of the spring member 143.

According to the exemplary embodiments of FIGS. 1 and 2, the ink ribbon cassette 100 includes a plate member 150 with an outer side portion 152 and and an inner side portion 154, which is coupled to the first and second support members 40 and 50 as discussed above. An alignment plate 160 is coupled to the outer side portion 152 of the plate member 150, and in the exemplary embodiment, the first alignment aperture 110 extends through the plate member 150 and through the alignment plate 160. FIGS. 1 and 2 show the first alignment member 60 protruding through the first alignment aperture 110 of the plate member 50 and the alignment plate 160. The alignment plate 160 also pivotally supports a door 170 for substantially covering an otherwise exposed side portion of the print head 30, which may have moving parts and may be heated. A recess 172 in the door provides access to a typeholder handle H, which is used to remove the typeholder from the print head 30. FIG. 2 shows the locking pin 80 rotatably coupled to the first alignment member 60 by a bearing or other means, wherein the locking pin 80 is proximate the engagement surface 132 of the lever 130 when the ink ribbon cassette 100 is aligned with the imprinting system 10.

According to another aspect of the invention shown in FIG. 1, a handle 200 is coupled to the outer side portion 152 of the plate member 150. The handle 200 has a generally H-shaped configuration defined by two substantially parallel gripping members 210 and 220 interconnected by a substantially transverse gripping member 230, wherein the handle 200 is coupled substantially parallel to the outer side portion 152 of the ink ribbon cassette 100. The handle 200 is also disposed in spaced relation to the outer side surface 152 of the plate member 150 to permit grasping the gripping members 210, 220, and 230 without obstruction or interference from the outer side portion 152. The spatial relationship of the several gripping members 210, 220 and 230 relative to each other provides a variety of different gripping surfaces, which are readily accessible to personnel regardless of the orientation of the imprinting system 10 in production line operations. The gripping members 210 and 220 provide means for readily gripping the ink ribbon cassette 100 at opposing end portions along the major dimension of the ink ribbon cassette 100, and the interconnecting substantially transverse gripping member 230 provides means for readily gripping the ink ribbon cassette intermediate and transverse to the gripping members 210 and 220. FIG. 2 shows a curved inner surface 240 formed on the inner side portion, which faces the outer side portion 152 of the plate member 150, of all the gripping members. The curved inner surfaces 240 provide an ergonomic gripping surface that is relatively comfortable to personnel handling the ink ribbon cassette 100. The handle 200 is also proportioned and coupled to the ink ribbon cassette 100 to provide gripping members in locations where the ink ribbon cassette is relatively balanced when handled by personnel. And according to another aspect of the invention, the several gripping members of the handle 200 provide a relatively flat support platform on which the ink ribbon cassette is stably supportable with the inner side portion 154 of the plate member 150 facing upwardly to facilitate access to the ink ribbon rolls and other components of the ink ribbon cassette 100 when the cassette 100 is disassembled from the imprinting system 10 for servicing and maintenance.

According to another aspect of the invention, the handle 200 is shaped and interconnected to the ink ribbon cassette 100 to reduce the materials and structural modification or fabrication required to mount the handle 200. FIGS. 1 and 2 show a portion of the handle 200 coupled to the ink ribbon cassette 100 by a first shaft member 90 extending through the support plate 150. A first end portion of the shaft 92 on the inner side portion 154 of the plate 150 is coupled to an ink ribbon roll 20, and a second end portion 94 on the outer side portion 152 of the plate 150 is coupled to a handle portion by a screw thread. In the exemplary embodiment, a sleeve 96 is disposed over or about the shaft 90 for providing support between the handle 200 and the outer side portion 152 of the ink ribbon cassette 100. FIG. 1 shows two shafts 90 and corresponding outer sleeves 96 supporting one of the gripping members 210 in space relation, wherein a typical imprinting system includes a ribbon supply reel coupled to one of the shafts 90 and a ribbon take-up reel is coupled to the other of the shafts 90. According to this configuration, handle 200 and the ribbon reels and the handle 200 are mounted to the plate member 150 by common corresponding shafts 90, which reduces materials usage and weight. And an opposing end portion of the handle 200 in the exemplary embodiment is coupled to the outer side portion 152 of the ink ribbon cassette 100 by a mounting block 250, wherein the mounting block 250 efficiently houses the biasing member 140 and supports the pivoting pin 134 of the lever 120.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. An imprinting system having a typeface for transferring ink supplied from an inked ribbon roll onto a substrate, the system comprising:

an ink ribbon cassette removably coupleable to the imprinting system, the ink ribbon cassette having a first alignment aperture;

a lever having an engagement surface, the lever pivotally coupled to the ink ribbon cassette;

a mounting member coupled to the imprinting system;

a first alignment member coupled to the imprinting system;

a locking pin coupled to the imprinting system, wherein the first alignment member is disposeable in the first alignment aperture of the ink ribbon cassette to align the ink ribbon cassette relative to the imprinting system, and wherein the engagement surface of the lever is engageable with the locking pin as the lever is pivoted to firmly retain the ink ribbon cassette mounted on the mounting member.

2. The system of claim 1, the engagement surface of the lever is an arcuate surface with a decreasing radius of curvature, the locking pin is rotatable about a pin axis, and the arcuate surface of the lever is engageable with the rotatable locking pin as the lever is pivoted to draw the ink ribbon cassette toward the imprinting system and firmly retain the ink ribbon cassette mounted on the mounting member.

3. The system of claim 1, the mounting member includes two first support members coupled to the imprinting system, each of the first support members having a corresponding first support surface, the ink ribbon cassette having two idler support shafts with corresponding end portions, wherein each end portion of the idler shafts is mountable on a corresponding one of the first support surfaces of the first support members.

4. The system of claim 1 wherein the first alignment member is a tongue member protruding from the imprinting system, the tongue member disposeable in the first alignment aperture of the ink ribbon cassette, and the locking pin is coupled to the tongue member.

5. The system of claim 4 wherein the mounting member includes a second support member coupled to the imprinting system, the second support member having a second support surface and an alignment stud protruding from the second support member, the ink ribbon cassette having a second alignment recess for receiving the alignment stud, wherein the alignment stud is disposeable in the second alignment recess of the ink ribbon cassette, and wherein the engagement surface of the lever is engageable with the locking pin as the lever is pivoted to firmly retain the ink ribbon cassette mounted on the second support member.

6. The system of claim 1 further comprising a handle coupled to an outer side portion of the ink ribbon cassette, the handle having two substantially parallel gripping members interconnected by a substantially transverse gripping member, wherein the handle is coupled substantially parallel to the outer side portion of the ink ribbon cassette to provide multiple hand gripping surfaces, wherein the ink ribbon cassette is stably supportabe by the handle when the ink ribbon cassette is disassembled from the imprinting system.

7. A method for transferring ink supplied from an inked ribbon roll onto a substrate with a typeface of an imprinting system, the method comprising steps of:

aligning an ink ribbon cassette relative to the imprinting system by disposing a first alignment member coupled to the imprinting system in a first alignment aperture of the ink ribbon cassette;

pivoting a lever pivotally coupled to the ink ribbon cassette to engage an engagement surface of the lever with a locking pin coupled to the imprinting system when the ink ribbon cassette is aligned with the imprinting system;

drawing the ink ribbon cassette toward the imprinting system by engaging an arcuate surface of the engagement surface with the locking pin as the lever is pivoted, the arcuate surface having a decreasing radius of curvature; and firmly retaining the ink ribbon cassette mounted on a mounting member coupled to the imprinting system when the arcuate engagement surface of the lever is engaged with the locking pin.

8. The method of claim 7 further comprising steps of aligning the ink ribbon cassette relative to the imprinting system by disposing a second alignment member protruding from a second support member coupled to the imprinting system in a second alignment recess of the ink ribbon cassette;

disposing the second alignment member in the second alignment recess of the ink ribbon cassette after disposing the first alignment member in the first alignment aperture of the ink ribbon cassette; and firmly retaining the ink ribbon cassette mounted on the second support member coupled to the imprinting system when the arcuate engagement surface of the lever is engaged with the locking pin.

9. An imprinting system having a typeface for transferring ink supplied from an inked ribbon roll onto a substrate, the system comprising:

an ink ribbon cassette removably coupleable to the imprinting system;

a handle coupled to an outer side portion of the ink ribbon cassette, the handle having two substantially parallel gripping members interconnected by a substantially transverse gripping member, a first shaft extending through the ink ribbon cassette, the ink ribbon roll coupled to a first portion of the first shaft on an inner side portion of the ink ribbon cassette, and the handle coupled to a second portion of the first shaft on the outer side portion of the ink ribbon cassette, the handle is coupled substantially parallel to the outer side portion of the ink ribbon cassette to provide multiple hand gripping surfaces.

10. The system of claim 9, the two substantially parallel gripping members interconnected by the substantially transverse gripping member of the handle have a generally H-shaped configuration disposed in spaced relation to and coupled substantially parallel to the outer side portion of the ink ribbon cassette.

11. An imprinting system having a typeface for transferring ink supplied from an inked ribbon roll onto a substrate, the system comprising:

an ink ribbon cassette removably coupleable to the imprinting system;

a plate member defining an outer side portion of the ink ribbon cassette and an inner side portion of the ink ribbon cassette, the ink ribbon cassette rotatably supporting the ink ribbon roll on the inner side portion of the ink ribbon cassette, the outer side portion of the plate member forms an outer side portion of the imprinting system;

a handle coupled to the outer side portion of the ink ribbon cassette, the handle having two substantially parallel gripping members interconnected by a substantially transverse gripping member, the handle is coupled substantially parallel to the outer side portion of the ink ribbon cassette to provide multiple hand gripping surfaces.

* * * * *